US010926155B2

(12) United States Patent
Simmons, Jr.

(10) Patent No.: US 10,926,155 B2
(45) Date of Patent: Feb. 23, 2021

(54) ADJUSTABLE BASKETBALL TRAINING DEVICE

(71) Applicant: Clinton Simmons, Jr., Woodbridge, VA (US)

(72) Inventor: Clinton Simmons, Jr., Woodbridge, VA (US)

( * ) Notice: Subject to any disclaimer, the term of this patent is extended or adjusted under 35 U.S.C. 154(b) by 145 days.

(21) Appl. No.: 16/369,228

(22) Filed: Mar. 29, 2019

(65) Prior Publication Data

US 2020/0306613 A1 Oct. 1, 2020

(51) Int. Cl.

*A63B 71/02* (2006.01)
*A63B 69/00* (2006.01)
*A63B 24/00* (2006.01)

(52) U.S. Cl.

CPC ..... *A63B 71/023* (2013.01); *A63B 24/0006* (2013.01); *A63B 24/0062* (2013.01); *A63B 69/0071* (2013.01); *A63B 2024/0028* (2013.01); *A63B 2071/026* (2013.01); *A63B 2243/0037* (2013.01)

(58) Field of Classification Search

CPC ..... A63B 71/023; A63B 24/0006; A63B 24/0062; A63B 69/0071; A63B 2024/0028; A63B 2071/026; A63B 2243/0037

USPC ..... 473/422

See application file for complete search history.

(56) References Cited

U.S. PATENT DOCUMENTS

2011/0283819 A1* 11/2011 Paulus ..... A63B 69/345 73/865.4
2013/0059680 A1* 3/2013 Lloyd ..... A63B 69/0071 473/422

FOREIGN PATENT DOCUMENTS

CN 105963946 A * 9/2016

OTHER PUBLICATIONS

Meng Translation All Pages, 2016.*

* cited by examiner

*Primary Examiner* — John E Simms, Jr.
*Assistant Examiner* — Rayshun K Peng
(74) *Attorney, Agent, or Firm* — Deidre McAuley

(57) ABSTRACT

Provided is an adjustable basketball training device that includes a weighted base portion to provide upright support to the device on a flat surface, a main leg portion connected at a first end thereof with the base portion and adjustable therefrom in a vertical direction, extension arm portions securely connected together, and connected with a second end of the main leg portion and extending in a horizontal direction, each having a sensor sensing physical contact of the user with each extension arm portion, start and stop operation switch portions connected to the second end of the main leg portion and an end of an extension arm portion opposite an end connected with another extension arm portion of the extension arm portions attached to the second end of the main leg portion, and a digital counter which counts a total number of times the user physically contacts each extension arm portion.

18 Claims, 10 Drawing Sheets

ADJUSTABLE BASKETBALL TRAINING DEVICE

FIELD OF THE INVENTION

The present invention relates to a basketball training device. In particular, an adjustable basketball training device capable of teaching crossover dribbling of a user and able to electronically track progress of the user during use thereof.

BACKGROUND OF THE INVENTION

Basketball is a sport which requires specific training and skills. One such skill is crossover dribbling in which a basketball player dribbles a basketball within one hand and quickly switches (i.e., crosses over) the basketball to the other hand with minimal bounce in front of another player.

Current basketball training devices are typically stationary devices which are unable to be adjusted to each individual user and are unable to track the progress of a user during use.

It is therefore desirable to provide an adjustable basketball training device capable of electronically tracking a user's progress, to thereby effectively train each user to perform a crossover dribble move.

SUMMARY OF THE INVENTION

According to one embodiment of the present invention, an adjustable basketball training device is provided. The adjustable basketball training device includes a weighted base portion to provide upright support to the device on a flat surface, a main leg portion connected at a first end thereof with the base portion and adjustable therefrom in a vertical direction, extension arm portions securely connected together, and connected with a second end of the main leg portion and extending in a horizontal direction, each having a sensor sensing physical contact of the user with each extension arm portion, start and stop operation switch portions connected to the second end of the main leg portion and an end of an extension arm portion opposite an end connected with another extension arm portion of the extension arm portions attached to the second end of the main leg portion, and a digital counter which counts a total number of times the user physically contacts each extension arm portion.

The present invention also provides a method of performing training of a crossover dribble move using the above-mentioned adjustable basketball training device.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION OF THE INVENTION

The present invention describes an adjustable basketball training device capable of adjusting and tracking the success of a user, to thereby effectively train the player to perform a basketball move (e.g., a crossover dribble move). One skilled in the art however will understand that the present invention may have additional embodiments and that the other embodiments of the invention may be practiced without several of the specific features described below. Although the present invention is described with use in training a player to perform a crossover dribble move, the adjustable basketball training device described in the present invention may also be used to effectively train other basketball moves such as "behind the back", "between the legs" and "in & out".

Figure 1:
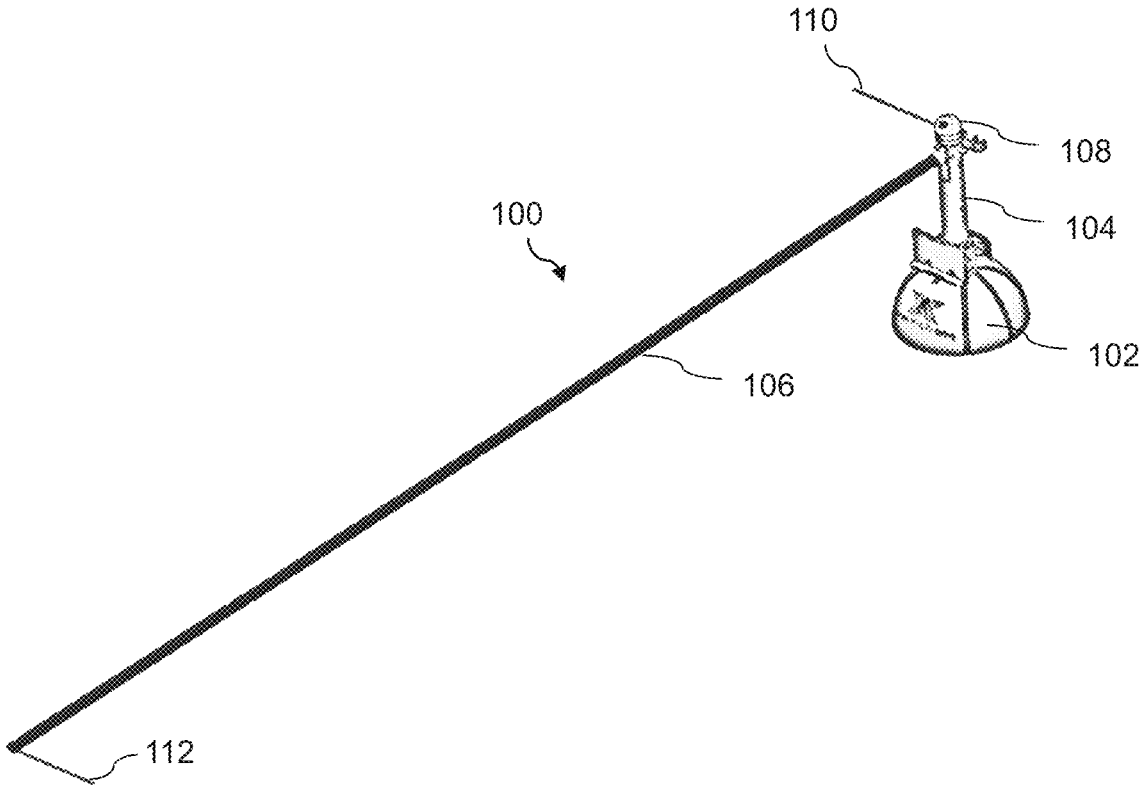
FIG. 1 is a perspective view of an adjustable basketball training device that can be implemented within one or more embodiments of the present invention.
Figure 2:
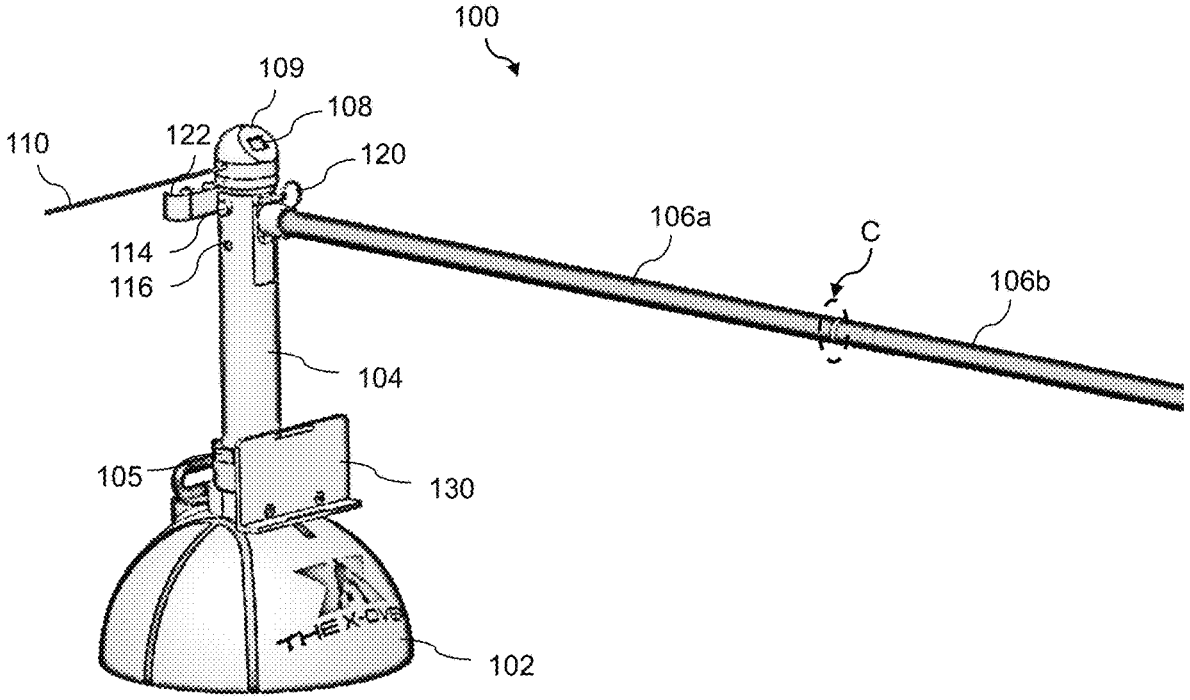
FIG. 2 is a side view of the adjustable basketball training device shown in FIG. 1, according to one or more embodiments of the present invention.
Figure 3:
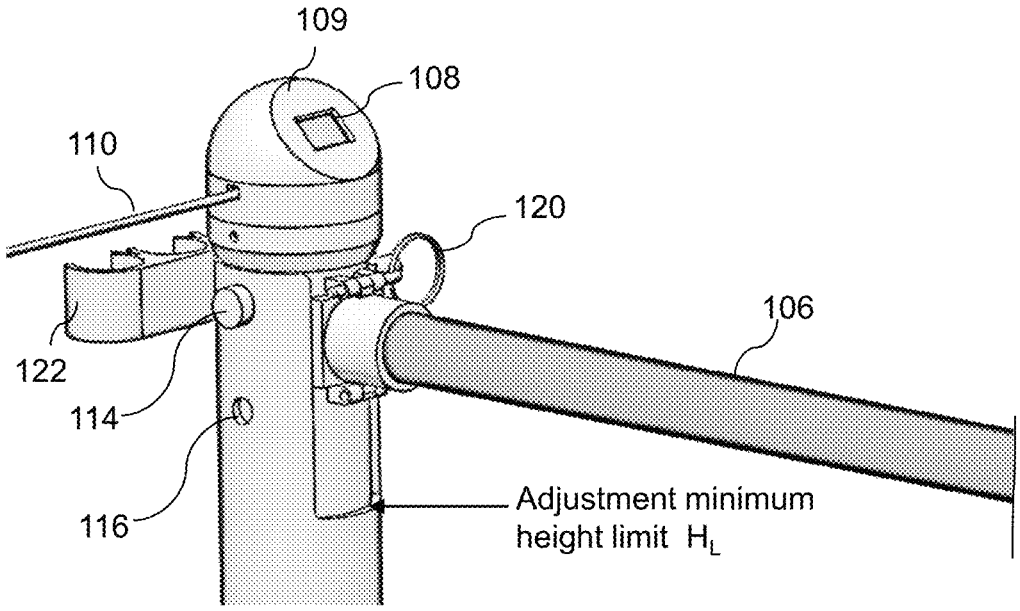
FIG. 3 is a detailed view of main leg portion including the display of the adjustable basketball training device shown in FIG. 1, according to one or more embodiments of the present invention.
Figure 8:
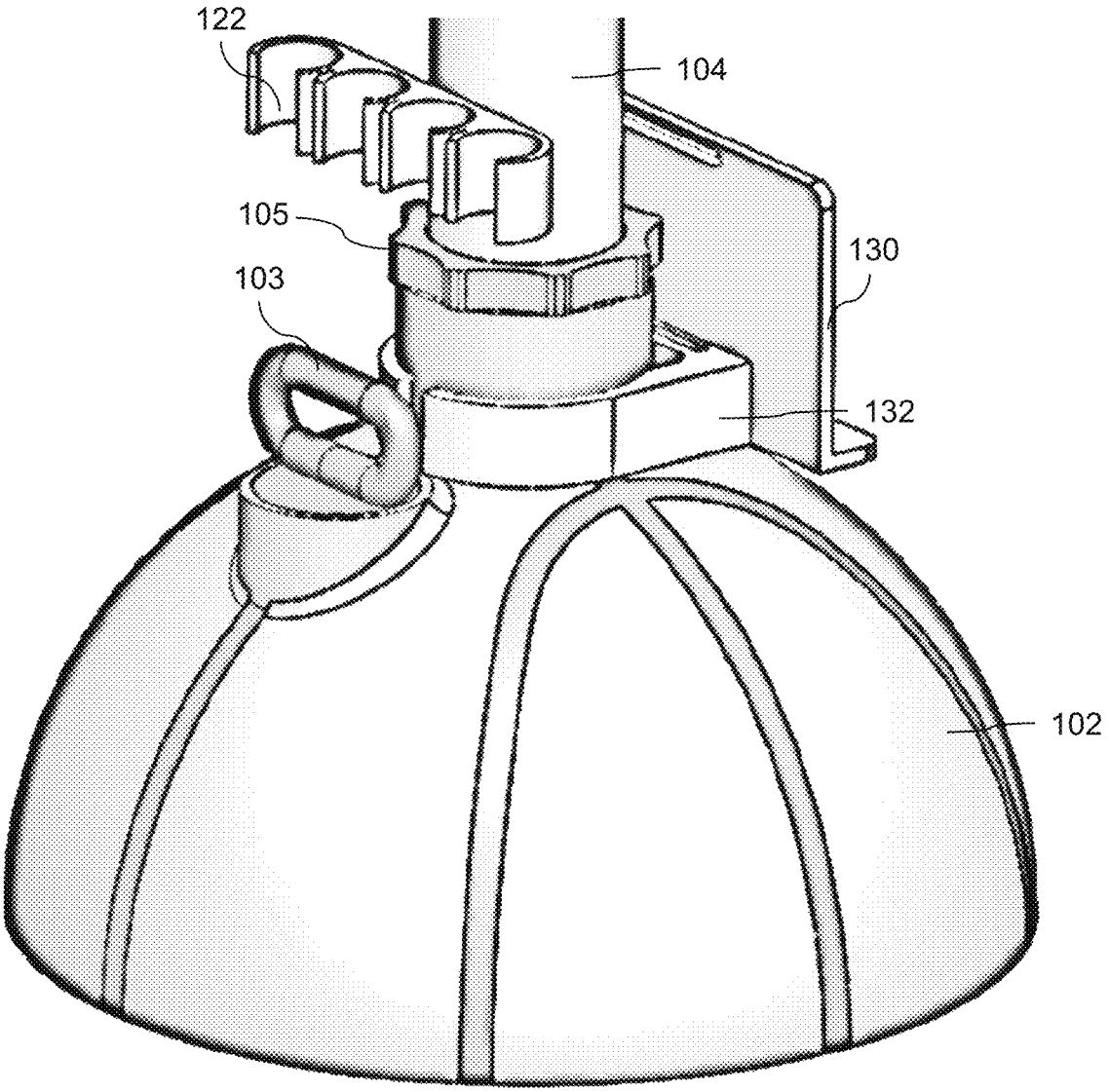
FIG. 8 a detailed view of the weighted base portion of the adjustable basketball training device of FIG. 1, according to one or more embodiments of the present invention.
Figure 9:
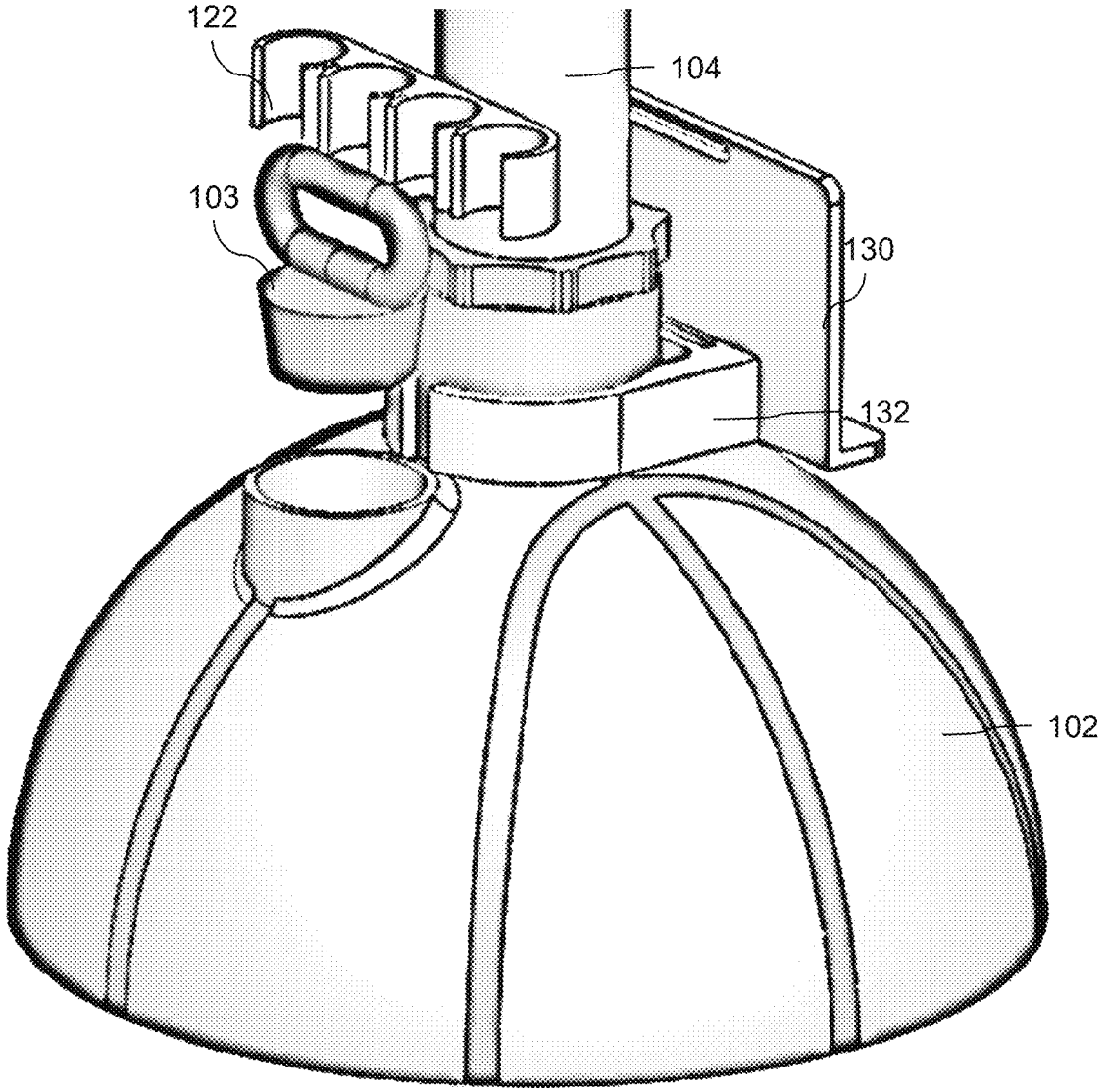
FIG. 9 is a detailed view for facilitating filling of the weighted based portion of FIG. 8, according to one or more embodiments of the present invention.

With reference now to FIGS. 1 through 3, an adjustable basketball training device 100 is provided for training a player to perform a crossover dribble move. The basketball training device comprises a weighted base portion 102 disposed along a flat surface (e.g., a floor surface) to provide upright support of the device 100 during use. As shown in FIGS. 8 and 9, the weighted base portion 102 includes a plug 103 for facilitating filling of the weighted base portion 102. The weighted base portion 102 may be filled with any weighted substance, for example, sand or water, suitable for weighing down and provided fixed support of the device 100 during use.

According to one or more embodiments, the weighted base portion 102 may be formed of any size or shape that is suitable for the purposes as set forth herein. As shown in FIG. 1, the weighted base portion 102 is of the shape of a half of a basketball.

Figure 4:
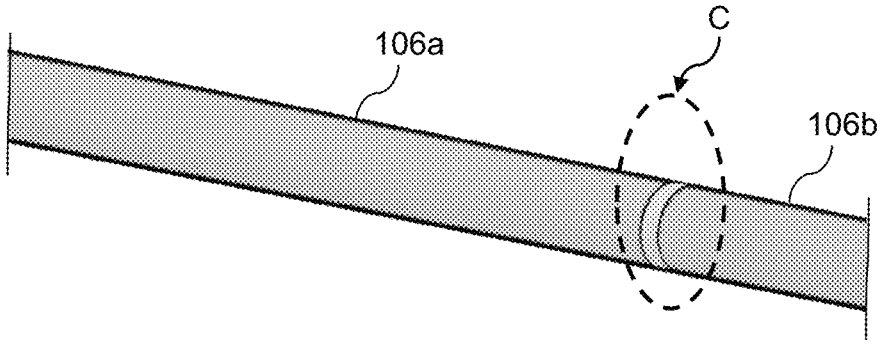
FIG. 4 is a detailed view of a connection point between a pair of extension arm portions of the adjustable basketball training device of FIG. 1, according to one or more embodiments of the present invention.

The device 100 further includes a main leg portion 104 connected at a first end thereof to the weighed base portion 102 and secured therewith by a securing means 105 (as depicted in FIGS. 2 and 8), and connected at a second end thereof to a display 108 in a housing 109. The device 100 further includes one or more extension arm portions 106 (106*a* and 106*b* as depicted in FIG. 4), and stop and start switch arm portions 110 and 112, respectively. Additional details will be discussed below with reference to FIGS. 2 through 9.

As shown in FIGS. 2 and 3, the main leg portion 104 is adjustable in height and includes a removable pin 114 and a plurality of openings 116 on a side thereof. The removable pin 114 can be removed from the side thereof whereby a user can raise the main leg portion 104 to a desired height within a maximum range of approximately 12 inches to approximately 24 inches, and re-insert the pin 114 into one of the openings 116 to secure the main leg portion 104 at a fixed height as desired by the user. The present invention is not limited to any particular height and can be manufactured to be varied, as necessary.

The present invention includes multiple extension arm portions 106 and is not limited to any particular number. A height of the extension arm portions 106 when disposed on the device 100 is increased upon the user adjusting the height of the main leg portion 104, as mentioned above, whereby the adjustment minimum height limit HL is as shown in FIG. 3. The extension arm portions 106 extend in a vertical direction away from the main leg portion 104 and can be extended to a length as desired by the user, up to a maximum range of approximately 2 feet to approximately 10 feet. However, the present invention is not limited hereto and can be designed to vary in length, as necessary. The extension arm portions 106 are formed of carbon fiber material for example. However, they may be formed of any other material type suitable for the purpose set forth herein. The extension arm portions 106*a* and 106*b* (as depicted in FIG. 4) can snap fitted together via a connection point "C" as shown in FIGS. 2 and 4) and can detached from each other and prepared for storage by removing a hinge pin 120 from a side portion of the main leg portion 104 facing the extension arm portions 106 and then removing the extension arm portion 106 directly connected to the main leg portion 104. These extension arm portions 106, 106*a* and 106*b* are then stored via the storage holder 122 disposed at a back side of the main leg portion 104 opposite the side that the extension arm portions 106 can be attached thereto. As shown in the figures, the storage holder 122 can be disposed at a top of the main leg portion 104 near the display 108 or at a bottom of the main leg portion 104 near the weighted base portion 102.

The extension arm portions 106, 106*a* and 106*b* each further includes a sensor 142 (e.g., an electronic sensor) capable of sensing physical contact of a user with each extension arm portion 106, 106*a* and 106*b*. Details regarding the sensing operation will be discussed below with reference to FIG. 6.

Referring back to FIGS. 2 and 3, the display 108 is disposed within the housing 109 at a top portion of the main leg portion 104 and is configured to display status information to the user of the device 100. The status information can include the number times the user hits the extension arm portion 106 during use, which is an indication of the user's training progress. The display 108 is not limited to provide status information and can be programmed to provide other suitable information useful to the user, as programmed, such as current time, date information.

The device 100 further includes a user device (e.g., a mobile phone) holder 130 for holding the user device during use of the device 100. The user device holder 130 is connected with the main leg portion 104 via a connector 132. Details regarding use of the user device in communication with the device 100 will be discussed below with reference to FIG. 7.

Figure 6:
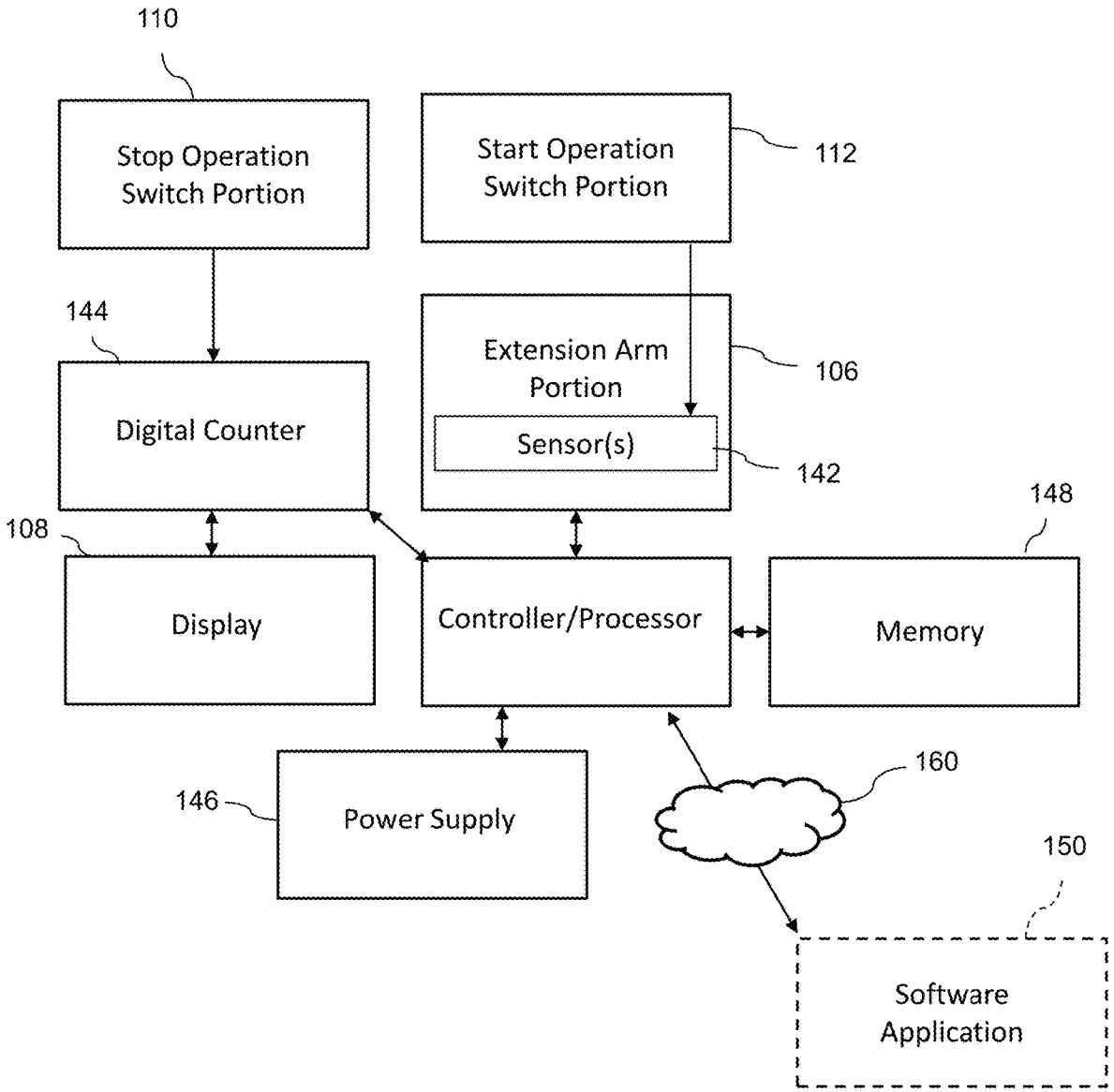
FIG. 6 is a block diagram illustrating the components for the cross-over dribble training operation of the adjustable basketball training device of FIG. 1, according to one or more embodiments of the present invention.

As shown in FIGS. 1 through 3, the stop switch arm portion 110 and the start switch arm portion 112 are connected to respective ends of the device 100. The stop switch arm portion 110 is connected to a top side of the main leg portion 104 and the start switch arm portion 112 is connected to an end of the extension arm portion 106 nearest the user during use of the device 100. The stop and start arm portions 110 and 112 are formed of a flexible material to allow the user to physically contact or hit the portion 110 or 112 to facilitate operation of a digital counter (144 as depicted in FIG. 6) of the device 100. The portions 110 and 112 are not limited to being formed of any particular flexible material and can be varied as necessary. According to alternative embodiments, the present invention may implement laser technology or other technology to facilitate start and stop operation of the digital counter 144 (as depicted in FIG. 6), display 108 and other components of the device 100. For example, an infrared laser having a range of approximately 1 foot may be used. And when a laser beam at the end of the last extension arm portion 106 is broken the digital counter 144 and display 108 will start and when a laser beam near the display 108 is broken the digital counter 144 and display 108 will stop.

Figure 5:
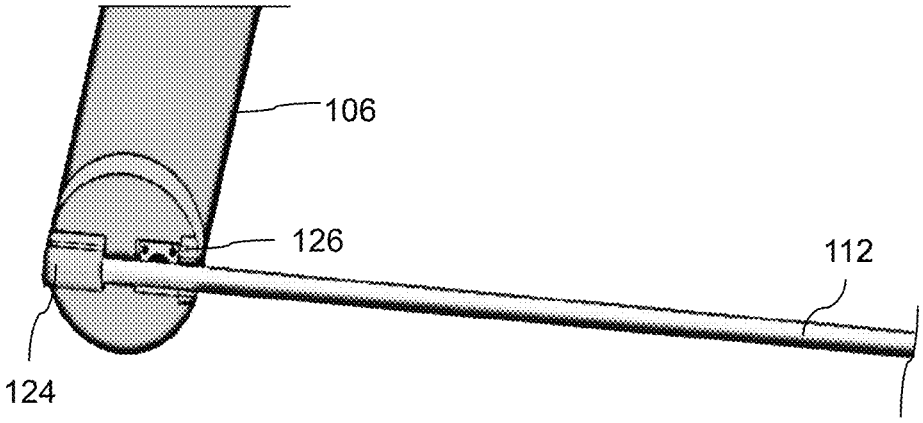
FIG. 5 is a detailed view of the start switch portion attached to an end of an extension arm portion of the adjustable basketball training device of FIG. 1, according to one or more embodiments of the present invention.

As shown in FIG. 5, the start switch arm portion 112 is connected to the extension arm portion 106 via a connector 124 and a holder portion 126. The connector 124 and the holder portion 126 secure start switch arm portion 112 in place during use.

Figure 7:
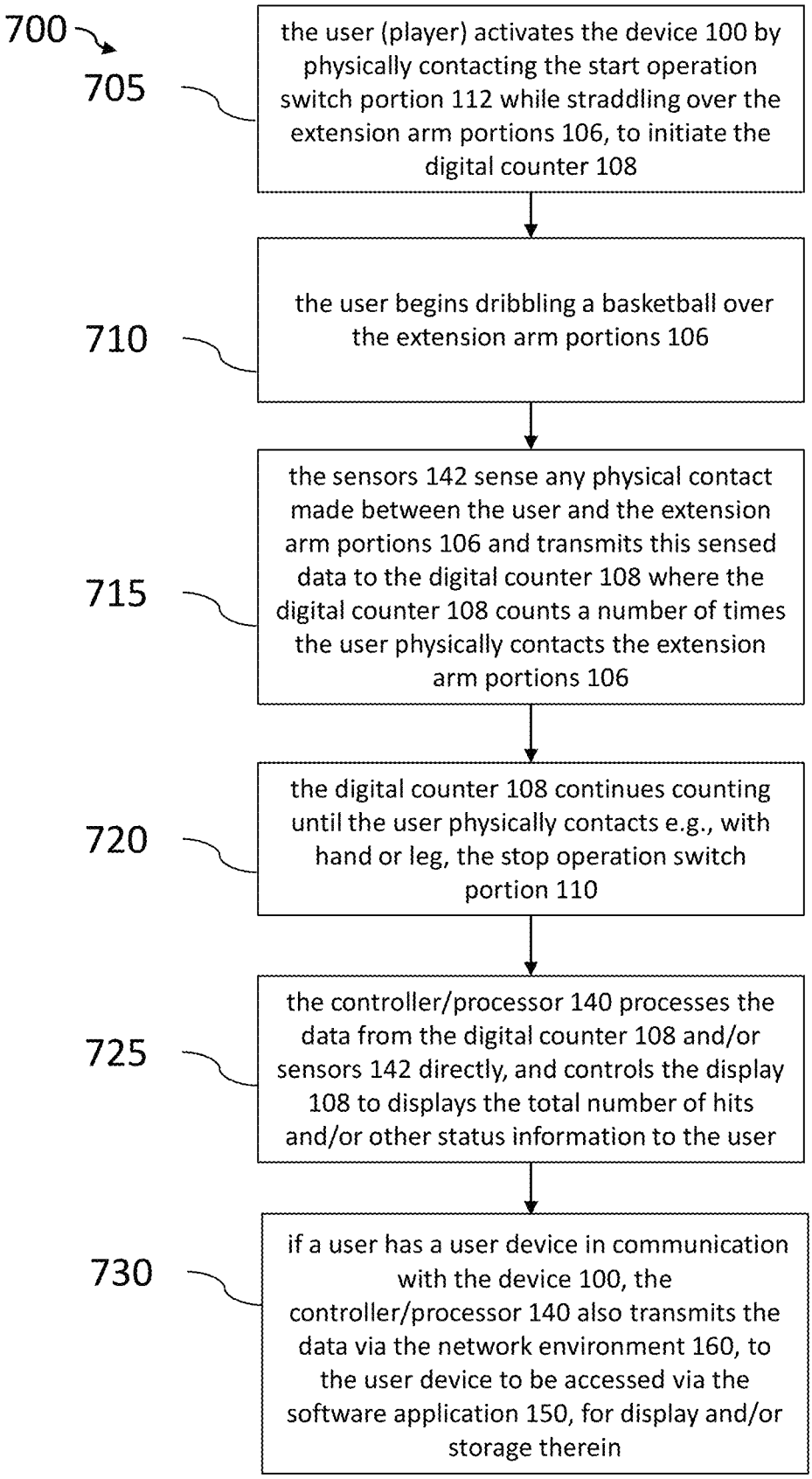
FIG. 7 is a flow diagram illustrating a method of performing cross-over dribble training using the adjustable basketball training device shown in FIG. 1 according to one or more embodiments of the present invention.

Details regarding operation of the device 100 will now be discussed with reference to FIGS. 6 and 7.

As shown in FIG. 6, the device 100 further includes a controller/processor 140 for controlling operation of the components of the device 100 including multiple sensors 142 disposed in each extension arm portion 106 and connected with the start operation switch portion 112; a digital counter 144 connected with the display 108 and the sensors 142 and the stop switch arm portion 110; a power supply 146 for supplying power to the device 100, a memory 148 for temporarily storing the status information to be displayed to the user during use, and a software application 150 accessible by a user via a user device in communication with the device 100 over a network environment 160.

The controller/processor 140 can be a microcontroller, or other type of suitable control device capable of controlling operation of the components of the device 100. The controller/processor 140 can be separate components in communication to perform the control operations.

According to an embodiment, the display 108, the controller/processor 140, digital counter 144, power supply 146 and memory 148 are disposed within the housing 109. The present invention is not limited to all of these components being disposed in a particular part of the device 100, and the location thereof can be varied as necessary.

According to one or more embodiments, a single sensor 142 or multiple sensors 142 can be disposed within the extension arm portions 106. When the extension arm portions 106 are connected together at the connection points "C", the sensors 142 within each extension arm portion 106 are also connected to be in communication with each other and to transmit the sensed data to the digital counter 108 stored within the housing 109. The sensors 142 are electronic sensors for example, however any other sensors suitable for the purpose set forth herein can be used.

According to one or more embodiments, the digital counter 144 and the display 108 can be combined into a single component or two separate components working together. The digital counter 144 is configured to count and store within an internal memory and/or memory 148, the number of times a user physically contacts each extension arm portion 106. Any type of digital, electronic or other type of suitable counter can be used within the present invention.

The power supply 146 is configured to supply power to the device 100. According to one embodiment, the power supply 146 includes a universal serial bus (USB) port or interface disposed within the housing 109 to receive a cable connection from an external power source. Alternatively, according to other embodiments, the power supply can be a wired, wireless or solar power supply or any other type of power supply capable of enabling operation of the device 100. The power supply 146 can also be a battery e.g., a replaceable or rechargeable battery according to one or more alternative embodiments.

The memory 148 is configured to temporarily store the status information obtained from the digital counter 144 to thereby display this information to the user of the device 100. According to other embodiments, the memory 148 can be configured to store other information such as username, password, date, historical progress information, as desired by the user. This information can be retrieved from the user of the software application 160 via a user device housed on the user device holder 130 or via an external remote user device by web access. The memory 148 can include a flash memory or other type of media or machine-readable medium suitable for storing electronic instructions for operation of the device 100. The memory 148 is in communication with an internal memory of the digital counter 108, and can be a RAM, ROM or any other type of memory suitable for the purpose set forth herein.

The software application 150 is an application enabling access to the digital counter 108 when a user device is connected with the device 100 within the network environment 160. The network environment 160 can be a wired or wireless connection. The software application 150 is downloadable or installable remotely at the user device or on a cloud platform. It can be downloaded by a client or application (APP) store and implemented with the network environment 160 examples of which include Bluetooth™, Wi-Fi, or any other communication technology used within a user device. It works within a predetermined range or distance but it not limited hereto and may vary accordingly.

An operation of the device 100 within a method 700 will now be described with reference to FIG. 7. The method 700 begins after a user or player adds weight, if not pre-added, to the weighted base portion 102, attaches the extension arm portions 106 to the main leg 104, powers up the device 100 via the power supply 146, and optionally places a user device within the user device holder 130 and connects with the device 100. At operation 705, the user (player) activates the device 100 by physically contacting the start operation switch portion 112 while straddling over the extension arm portions 106, to initiate the digital counter 108. At operation 710, the user begins dribbling a basketball over the extension arm portions 106.

At operation 715, the sensors 142 sense any physical contact made between the user and the extension arm portions 106 and transmits this sensed data to the digital counter 108 where the digital counter 108 counts a number of times the user physically contacts the extension arm portions 106.

At operation 720, the digital counter 108 continues counting until the user physically contacts e.g., with hand or leg, the stop operation switch portion 110.

From operation 720, the process continues to operation 725, where the controller/processor 140 processes the data from the digital counter 108 and/or sensors 142 directly, and controls the display 108 to displays the total number of hits and/or other status information to the user.

In operation 730, if a user has a user device in communication with the device 100, the controller/processor 140 also transmits the data via the network environment 160, to the user device to be accessed via the software application 150, for display and/or storage therein.

Figure 10:
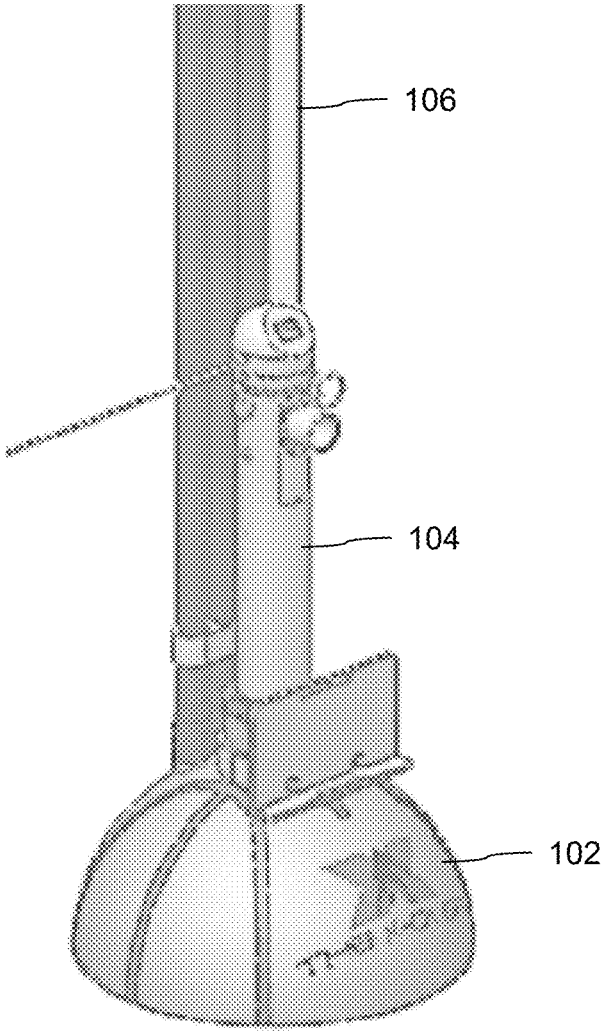
FIG. 10 is a detailed view showing storage of the extension arm portions within the adjustable basketball training device of FIG. 1, according to one or more embodiments.

As mentioned above, the device 100 is detachable for carrying and storage purposes after use. As shown in FIGS. 9 and 10 respectively, the weighted base portion 102 can be depleted by removing the plug 103 and emptying the contents (e.g., sand or water therein), and the extension arm portions 106 can be detached from one another at their connection points "C" and from the main leg portion 104 and stored within the storage removed and stored within the storage holder 122.

The adjustable basketball training device according to one or more embodiments of the present invention provides the advantages of allowing a user or player to monitor their speed and achieve efficient performance of the crossover dribble move, thereby enhancing their basketball skills.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. An adjustable basketball training device to train a user or player, the device comprising:

a housing;

a weighted base portion to provide upright support to the basketball training device on a flat surface;

a main leg portion connected at a first end thereof with the weighted base portion and adjustable therefrom in a vertical direction;

a plurality of extension arm portions to be securely connected together, and connected with a second end of the main leg portion and configured to extend in a horizontal direction away from the main leg portion, each comprising a sensor therein to sense physical contact of the user with each extension arm portion and configured to be straddled by a user when performing a basketball operation with a basketball;

start and stop operation switch portions respectively connected to the second end of the main leg portion and an end of an extension arm portion opposite an end connected with another extension arm portion of the plurality of extension arm portions attached to the second end of the main leg portion and in communication with each sensor; and a digital counter disposed within the housing and in communication with the start and stop operation switch portions and the sensors of each extension arm portion, and configured to count a total number of times the user physically contacts each extension arm portion.

2. The device of claim 1, wherein the weighted base portion further comprises a plug for facilitating filling of the weighted base portion with a weighted sub stance.

3. The device of claim 2, wherein the weighted substance comprises at least one of sand or water.

4. The device of claim 1, wherein the weighted base portion is of a shape of a half of a basketball.

5. The device of claim 1, comprises a removable pin, and the main leg portion is adjustable in height and comprises a plurality of openings on a side thereof, wherein the removable pin is removable to allow a user to raise the main leg portion to a desired height and re-insert the removable pin into one of the plurality of openings to secure the main leg portion at a fixed height.

6. The device of claim 5, wherein a height of the extension arm portions when disposed on the device is increased upon the user adjusting the height of the main leg portion.

7. The device of claim 1, wherein the plurality of extension arm portions are snap fitted together via a connection point and are detachable from each other for storage and from the main leg portion via a hinge pin from a side of the main leg portion.

8. The device of claim 1, further comprising a display disposed within the housing at a top portion of the main leg portion and configured to display status information to the user of the device.

9. The device of claim 8, wherein the status information includes a total number of times the user hits the extension arm portions during use.

10. The device of claim 8, further comprising:

a controller/processor configured to control operation of the device;

a power supply configured to supply power to the device; and a memory configured to temporarily store the status information to be displayed to the user during use.

11. The device of claim 10, further comprising:

a user device holder for holding a user device;

a software application configured to be accessible at the user device and in communication with the device over a network environment.

12. The device of claim 1, wherein when the plurality of extension arm portions are connected together, the sensors within each extension arm portion are connected to be in communication with each other and to transmit sensed data to the digital counter.

13. The device of claim 10, wherein the power supply includes a universal serial bus (USB) port or interface for supplying power from an external power source.

14. The device of claim 10, wherein the memory is further configured to store username, password, and historical progress information to be retrieved from the user using the software application at the user device.

15. The device of claim 11, wherein the network environment comprises Bluetooth™ or Wi-Fi technology.

16. A method of performing training of a crossover dribble move using an adjustable basketball training device comprising a main leg portion connected with extension arm portions having sensors therein and a digital counter in communication with the sensors, the method comprising:

activating the device by physically contacting a start operation switch portion while straddling over the extension arm portions 106 to initiate the digital counter;

performing a basketball operation over the extension arm portions;

sensing any physical contact made between the user and the extension arm portions and transmitting sensed data to the digital counter; and counting, via the digital counter, a number of times the user physically contacts each extension arm portion until the user physically contacts a stop operation switch portion.

17. The method of claim 16, further comprising:

processing, via a controller/processor of the device, data from the digital counter and/or sensors directly, and controlling a display to display a total number of hits and/or other status information to the user.

18. The method of claim 17, further comprising:

connecting a user device to the adjustable basketball training device, and transmitting, via the controller/processor data via a network environment to the use device, to be accessible by a software application for display and/or storage therein.

* * * * *